US006814515B2

(12) United States Patent
Tsuchiya et al.

(10) Patent No.: US 6,814,515 B2
(45) Date of Patent: Nov. 9, 2004

(54) PRINTING APPARATUS AND TERMINAL APPARATUS

(75) Inventors: Masahiro Tsuchiya, Shinagawa (JP); Masaru Kihara, Shinagawa (JP); Fumio Sakurai, Shinagawa (JP); Sumio Watanabe, Shinagawa (JP)

(73) Assignee: Nagano Fujitsu Component Limited, Nagano (JP)

( * ) Notice: Subject to any disclaimer, the term of this patent is extended or adjusted under 35 U.S.C. 154(b) by 10 days.

(21) Appl. No.: 10/187,281

(22) Filed: Jul. 2, 2002

(65) Prior Publication Data

US 2003/0007823 A1 Jan. 9, 2003

(30) Foreign Application Priority Data

Jul. 9, 2001 (JP) ..... 2001-208083

(51) Int. Cl.[7] ..... B41J 11/70; B41J 15/02; B41J 13/08

(52) U.S. Cl. ..... 400/621; 400/635; 400/613

(58) Field of Search ..... 400/611, 613, 400/621, 635; 235/379; 902/12, 18

(56) References Cited

U.S. PATENT DOCUMENTS 4,915,525 A * 4/1990 Hosoi ..... 400/583
5,201,588 A * 4/1993 Sakai et al. ..... 400/613
5,706,729 A * 1/1998 Tai et al. ..... 101/288
6,302,604 B1 * 10/2001 Bryant et al. ..... 400/619

FOREIGN PATENT DOCUMENTS

JP 04323157 A * 11/1992 ..... B65H/23/34
JP 9-234930 9/1997
JP 2002128347 A * 5/2002 ..... B65H/23/16

* cited by examiner

*Primary Examiner*—Daniel J. Colilla
(74) *Attorney, Agent, or Firm*—Staas & Halsey LLP

(57) ABSTRACT

A printing apparatus includes: a paper roll containing part containing a paper roll; a printer unit provided side by side with the paper roll containing part, the printer unit printing information on paper pulled from the paper roll and cutting a piece off the pulled paper on which piece the information is printed; and a presenter unit. The presenter unit includes a reception opening formed on an upper side thereof and receiving the cut piece of paper delivered from the printer unit, first and second ejection openings formed on opposite ends of the presenter unit and ejecting the cut piece of paper, and a conveying mechanism conveying the cut piece of paper between the first and second ejection openings. The presenter unit is provided below the paper roll containing part and the printer unit so that the cut piece of paper is delivered into the reception opening.

32 Claims, 12 Drawing Sheets

RECEIPT PREPARATION

RECEIPT CONVEYANCE

RECEIPT EJECTION

RECEIPT COLLECTION

SETTING ROLL PAPER

STARTING PRINTING

ENDING PRINTING

FIG.12

| | INCORPORATED POSITION | 1ST EJECTION OPENING 82 | 2ND EJECTION OPENING 83 | 3RD EJECTION OPENING 84 |
|---|---|---|---|---|
| (a) | FIG.7A | EJECTION | COLLECTION | - |
| | | EJECTION | - | COLLECTION |
| | | EJECTION | COLLECTION | COLLECTION |
| | | EJECTION | COLLECTION | EJECTION |
| | | EJECTION | EJECTION | COLLECTION |
| | | EJECTION | - | - |
| (b) | FIG.7B | COLLECTION | EJECTION | - |
| | | - | EJECTION | COLLECTION |
| | | COLLECTION | EJECTION | COLLECTION |
| | | EJECTION | EJECTION | COLLECTION |
| | | COLLECTION | EJECTION | EJECTION |
| | | - | EJECTION | - |
| (c) | FIG.7C | - | COLLECTION | EJECTION |
| | | COLLECTION | - | EJECTION |
| | | COLLECTION | COLLECTION | EJECTION |
| | | EJECTION | COLLECTION | EJECTION |
| | | COLLECTION | EJECTION | EJECTION |
| | | - | - | EJECTION |

PRINTING APPARATUS AND TERMINAL APPARATUS

BACKGROUND OF THE INVENTION

1. Field of the Invention

The present invention generally relates to printing apparatuses and terminal apparatuses, and more particularly to a printing apparatus that is incorporated into bank automated teller machines (ATMs), cash dispensers, and kiosk terminal apparatuses and used to issue receipts and tickets and a terminal apparatus including such a printing apparatus.

A printing apparatus issuing receipts employs heat-sensitive roll paper as paper for printing. Especially, in the case of being incorporated into an unmanned ATM, the receipt-issuing printing apparatus is provided with a presenter unit collecting a receipt left behind inadvertently by a customer so that the next customer can not see the left-behind receipt.

Downsizing is a requirement for the ATMs in terms of space for installation. Accordingly, the receipt-issuing printing apparatus incorporated into the ATMs is required to become smaller in size.

The receipt-issuing printing apparatus has a receipt preparation mode for preparing a receipt by performing printing on paper and finally cutting off the printed part of the paper, a receipt ejection mode for ejecting the receipt for a customer, and a receipt collection mode for collecting the receipt left behind in case the customer forgets to take the receipt. If the receipt is ejected with printing being performed, the customer may pull the receipt while printing is still being performed, thereby causing a problem. Therefore, the receipt ejection mode is started after printing is completed.

2. Description of the Related Art

FIG. 1 is a diagram showing a conventional receipt-issuing printing apparatus 10. $X_1$–$X_2$ represents the directions of length and $Z_1$–$Z_2$ represents the directions of height. In the printing apparatus 10, a paper roll containing part 11, a printer unit 12 having a printer part and a cutter part, and a presenter unit 13 are arranged in the $X_1$ direction from the $X_2$ side. The presenter unit 13 has an opening 14 on the $X_2$ side and a receipt ejection slot 15 on the $X_1$ side. The opening 14 serves to receive and discharge receipts.

As shown in FIG. 1, the receipt-issuing printing apparatus 10 is incorporated into an ATM main body 20. The receipt ejection slot 15 opposes a receipt issuance slot 21. A receipt collection box 22 is provided in a position to receive the receipt ejected from the opening 14. A paper roll 30 is set in the paper roll containing part 11.

The printing apparatus 10 operates in the following manner.

Receipt Preparation Mode

The printer unit 12 performs printing on paper 31 while pulling the paper 31 from the paper roll 30, and cuts the paper 31 when completing printing, thereby preparing a receipt 35. In the process of preparation, the receipt 35 has its leading edge first entering the presenter unit 13 through the opening 14 and is delivered toward the receipt ejection slot 15. During printing, the presenter unit 13 operates at a low speed and delivers the paper 31 sent out from the printer unit 12 toward the $X_1$ direction without pulling the paper, 31 that is, without affecting the printer unit 12.

Receipt Ejection Mode

When printing is completed, the presenter unit 13 operates at a given speed and conveys the receipt 35 in the $X_1$ direction. Then, as shown in FIG. 1, the presenter unit 13 causes the receipt 35 to protrude, except for its trailing edge part, from the receipt ejection slot 15 and the receipt issuance slot 21, thereby completing ejection.

Receipt Collection Mode

If a customer forgets to pick up the receipt 35 so that the receipt 35 remains protruding from the receipt issuance slot 21 even after a given period of time passes since the completion of ejection, the presenter unit 13 operates in the reverse direction and conveys the receipt 35 toward the $X_2$ direction back into the receipt issuance slot 21. The conveyed receipt 35 is ejected from the opening 14 and collected into the receipt collection box 22.

In the printing apparatus 10, the paper roll containing part 11, the printer unit 12, and the presenter unit 13 are arranged from the $X_2$ side toward the $X_1$ direction. Therefore, the height $H_1$ of the printing apparatus 10 is small, but the length $L_1$ thereof is large.

Since the presenter unit 13 is arranged side by side with the printer unit 12, the length of the issued receipt 35 is determined by the length $L_2$ of the presenter unit 13. That is, the maximum length of the issued receipt 35 corresponds to the length $L_2$ of the presenter unit 13. In order to enlarge the maximum length of the issued receipt 35, it is necessary to enlarge the length $L_2$ of the presenter unit 13. However, if the length $L_2$ of the presenter unit 13 is enlarged, the length $L_1$ of the printing apparatus 10 becomes larger so that the printing apparatus 10 becomes bulky.

Further, when the printing apparatus 10 is incorporated into an ATM, the position of the printing apparatus 10 is limited to that shown in FIG. 1 without any degree of freedom. When the printing apparatus 10 is incorporated into an ATM in the position shown in FIG. 1, the dimension $L_3$ of the ATM main body 20 also becomes larger.

In addition, the paper roll containing part 11 receives the paper roll 30 from above. Therefore, a top plate 22 of the ATM main body 20 is opened before the paper roll 30 is set inside the paper roll containing part 11 from above. Accordingly, a space S for performing operations necessary for setting the paper roll 30 is required above the ATM main body 20. If the ATM main body 20 includes the space S, the height of the ATM main body 20 becomes large.

SUMMARY OF THE INVENTION

Accordingly, it is a general object of the present invention to provide a printing apparatus in which the above-described disadvantages are eliminated and a terminal apparatus including such a printing apparatus.

A more specific object of the present invention is to provide a downsized printing apparatus having more latitude in being incorporated into a terminal apparatus and therefore providing more freedom in designing the terminal apparatus.

Another more specific object of the present invention is to provide a terminal apparatus employing such a printing apparatus.

The above objects of the present invention are achieved by a printing apparatus including: a paper roll containing part containing a paper roll; a printer unit provided side by side with the paper roll containing part, the printer unit printing information on paper pulled from the paper roll and cutting a piece off the pulled paper on which piece the information is printed; and a presenter unit, the presenter unit including a reception opening formed on an upper side thereof and receiving the cut piece of paper delivered from the printer unit, first and second ejection openings formed on opposite ends of the presenter unit and ejecting the cut piece of paper, and a conveying mechanism conveying the cut piece of paper between the first and second ejection openings, wherein the presenter unit is provided below said paper roll containing part and the printer unit so that the cut piece of paper is delivered into the reception opening.

According to the above-described printing apparatus, the reception opening receiving the cut piece of paper delivered from the printer unit is formed on the upper side of the presenter unit. Therefore, the presenter unit is allowed to be provided below the paper roll containing part and the printer unit. Accordingly, compared with a configuration where the paper roll containing part, the printer unit, and the presenter unit are linearly arranged side by side, the printing apparatus is increased in height but reduced in length so as to be reduced in overall size. Further, the length of the cut piece of paper is not restricted by the length of the presenter unit. Therefore, the cut piece of paper may be issued with a length irrespective of the length of the presenter unit.

Further, since the presenter unit is provided below the paper roll containing part and the printer unit arranged side by side, one of the first and second ejection openings may be used for ejecting the cut piece of paper outside and the other of the first and second ejection openings may be used as an opening for ejecting the cut piece of paper to a collection box. Therefore, the printing apparatus may be incorporated into a terminal apparatus in two different positions, thus providing more freedom in designing the terminal apparatus.

The above objects of the present invention are also achieved by a terminal apparatus including a printing apparatus that includes: a paper roll containing part containing a paper roll; a printer unit provided side by side with the paper roll containing part, the printer unit printing information on paper pulled from the paper roll and cutting a piece off the pulled paper on which piece the information is printed; and a presenter unit including a reception opening formed on an upper side thereof and receiving the cut piece of paper delivered from the printer unit, first and second ejection openings formed on opposite ends of the presenter unit and ejecting the cut piece of paper, and a conveying mechanism conveying the cut piece of paper between the first and second ejection openings, wherein the presenter unit is provided below the paper roll containing part and the printer unit so that the cut piece of paper is delivered into the reception opening.

The above-described terminal apparatus including the printing apparatus according to the present invention is reduced in size compared with the conventional terminal apparatus, and is provided with more design freedom.

BRIEF DESCRIPTION OF THE DRAWINGS

Other objects, features and advantages of the present invention will become more apparent from the following detailed description when read in conjunction with the accompanying drawings, in which:

FIG. 12 is a table showing a receipt ejection and collection setting of a control setting circuit of the receipt-issuing line thermal printer of FIG. 2 for each of the incorporated positions thereof shown in FIGS. 7A through 7C.

DETAILED DESCRIPTION OF THE PREFERRED EMBODIMENTS

A description will now be given, with reference to the accompanying drawings, of an embodiment of the present invention.

Figure 2:
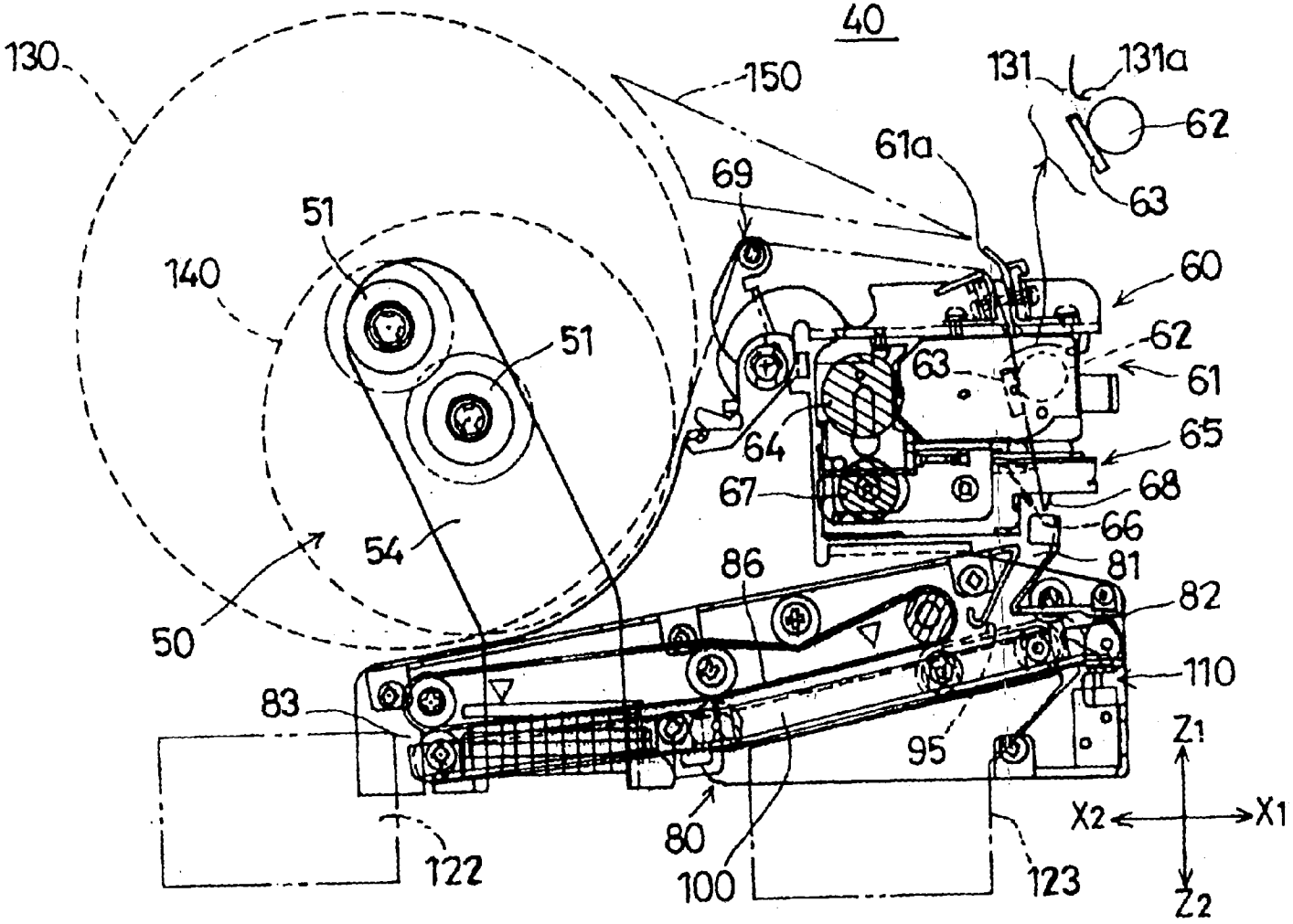
FIG. 2 is a diagram showing a receipt-issuing line thermal printer according to an embodiment of the present invention.
Figure 3:
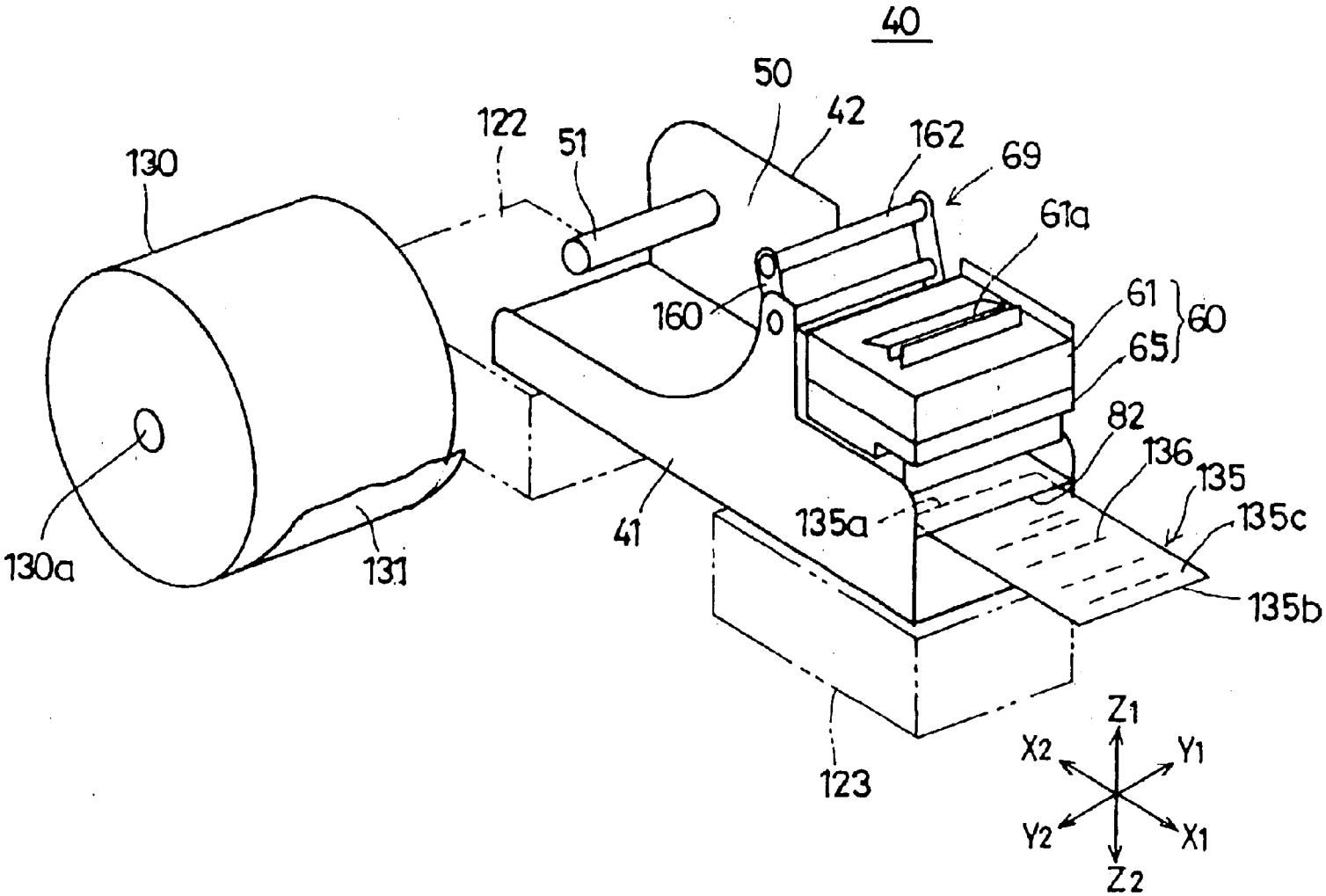
FIG. 3 is a perspective view of the receipt-issuing line thermal printer of FIG. 2.
Figure 4:
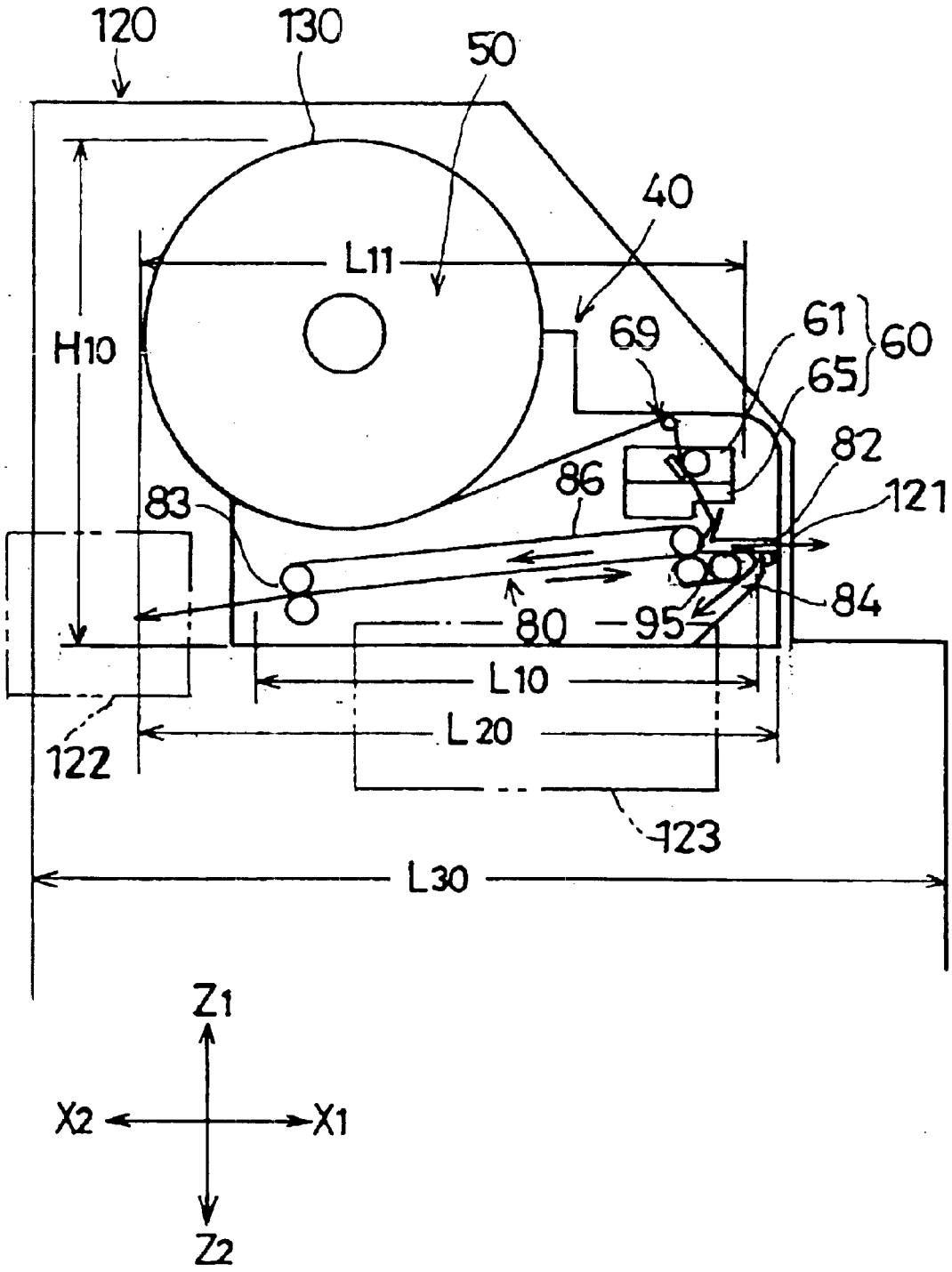
FIG. 4 is a schematic diagram showing the receipt-issuing line thermal printer of FIG. 2.

FIGS. 2 through 4 are diagrams showing a receipt-issuing line thermal printer 40 according to the embodiment of the present invention. $X_1$–$X_2$ represents the directions of length, $Y_1$–$Y_2$ represents the directions of width, and $Z_1$–$Z_2$ represents the directions of height. A paper roll containing part 50 and a printer unit 60 are arranged side by side along the $X_1$–$X_2$ axis. A presenter unit 80 is provided below the paper roll containing part 50 and the printer unit 60 to extend along the $X_1$–$X_2$ axis with a receipt (cut piece of paper) reception opening 81 thereof opposing a receipt discharging opening 68 of the printer unit 60. Frames 41 and 42 provided respectively to the $Y_2$ and $Y_1$ sides of the printer 40 as shown in FIG. 3 hold the paper roll containing part 50, the printer unit 60, and the presenter unit 80 in the above-described respective positions.

The paper roll containing part 50 includes a horizontal paper roll supporting shaft 51 fixed to the frame 42. A heat-sensitive paper roll 130 is set by being fitted to the paper roll supporting shaft 51 from the $Y_2$ side as shown in FIG. 3.

The printer unit 60 includes a printer part 61 and a cutter part 65 provided under the printer part 61. The printer part 61 has a roll paper reception opening 61*a* formed on the upper surface thereof. Further, the printer part 61 has a platen roller 62, a thermal head 63, and a paper feed motor 64 provided therein. The cutter part 65 includes a cutter blade 66 and a motor 67 moving the cutter blade 66. The receipt discharging opening 68 is formed on the lower surface of the cutter part 65.

A roll paper pull-in load reducing mechanism 69 is provided between the paper roll containing part 50 and the printer unit 60.

Figure 5:
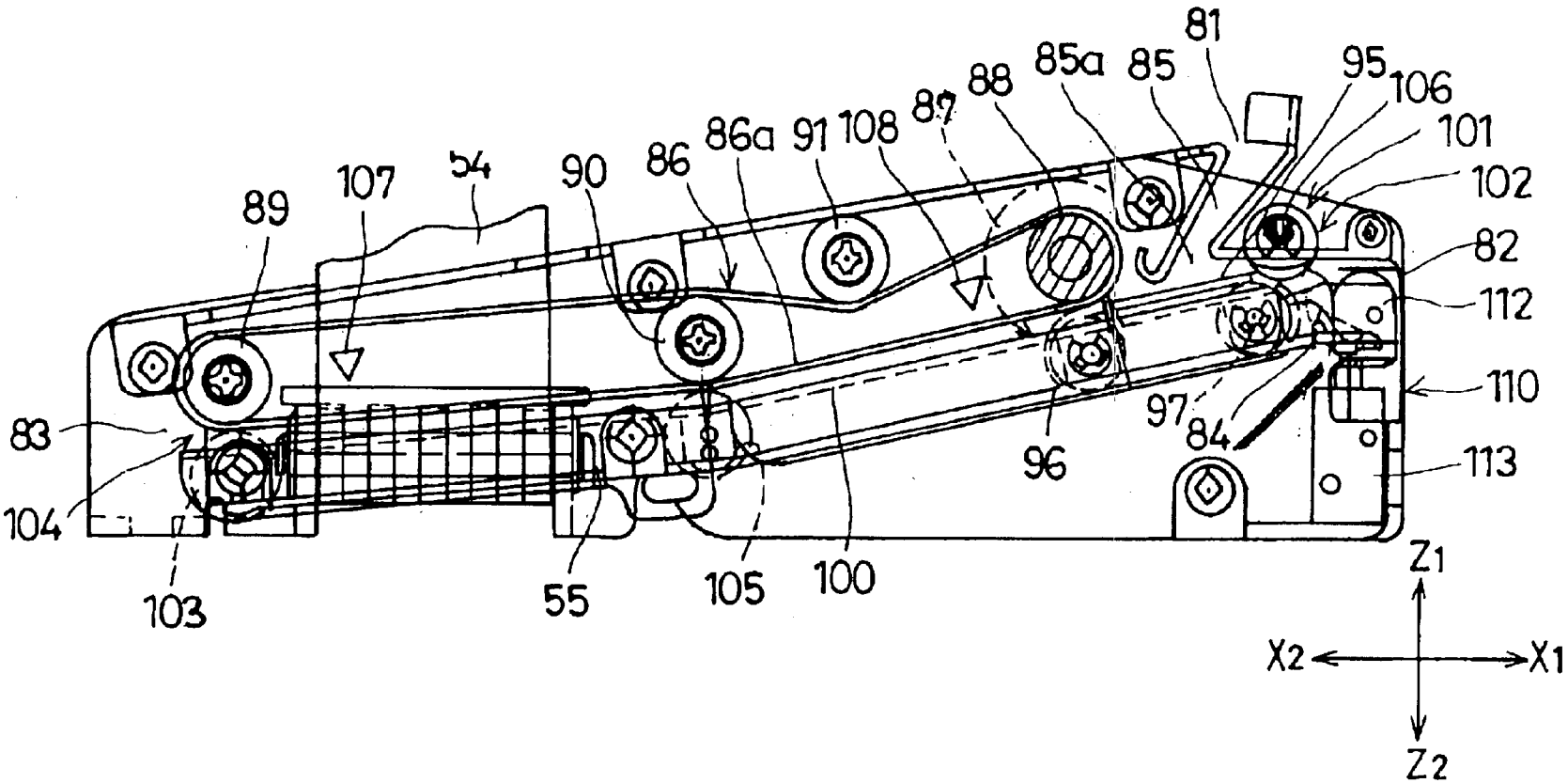
FIG. 5 is a diagram showing a presenter unit of the receipt-issuing line thermal printer of FIG. 2.

As also shown in FIG. 5, the presenter unit 80 includes the receipt reception opening 81 and first through third receipt ejection openings 82 through 84. The first through third receipt ejection openings 82 through 84 provided on the $X_1$, $X_2$, and $Z_2$ sides, respectively.

The receipt reception opening 81 is formed in the proximity of the $X_1$ end on the upper surface of the presenter unit 80. A receipt guide part 85 extends from the receipt reception opening 81, sloping downward toward a direction between the $Z_2$ and $X_2$ directions.

The first receipt ejection opening 82 is provided to the $X_1$ end. The second receipt ejection opening 83 is provided to the $X_2$ end. The third receipt ejection opening 84 is provided in the proximity of the $X_1$ end on the lower surface of the presenter unit 80. The first and third receipt ejection openings 82 and 84 are close to each other.

A first receipt-conveying belt 86 is provided between the receipt guide part 85 and the second receipt ejection opening 83, engaging a driving roller 88 driven by a motor 87 and a roller 89 to have a long loop in the $X_1$ and $X_2$ directions. A center roller 90 and a tension roller 91 are also provided.

A second receipt-conveying belt 95 is provided between the driving roller 88 and the first receipt ejection opening 82, engaging a roller 96 gear-driven by the driving roller 88 and a roller 97. The second receipt-conveying belt 95 extends further in the $X_1$ direction from the $X_1$ end of the first receipt-conveying belt 86. The second receipt-conveying belt 95 opposes an exit 85*a* of the receipt guide part 85.

A receipt guide 100 extends along a path 86*a* on the lower side of the first receipt-conveying belt 86 and a path on the upper side of the second receipt-conveying belt 95 between the first receipt ejection opening 82 and the second receipt ejection opening 83.

A roller 101 is positioned above the roller 97 and contacts the second receipt-conveying belt 95. The roller 101 and the second receipt-conveying belt 95 around the roller 97 form a receipt holding part 102 holding a receipt ejected from the first receipt ejection opening 82 or the third receipt ejection opening 84 by its trailing edge part.

A roller 103 is positioned below the roller 89 and contacts the first receipt-conveying belt 86. The roller 103 and the first receipt-conveying belt 86 form a receipt holding part 104 holding a receipt ejected from the second receipt ejection opening 83 by its trailing edge part.

A roller 105 is positioned below the center roller 90 and contacts the first receipt-conveying belt 86 guided by the center roller 90.

Optical receipt detection sensors 106 through 108 are provided to the receipt holding part 102, on the $X_1$ side of the receipt holding part 104, and on the $X_2$ side of the driving roller 88, respectively.

The first receipt-conveying belt 86, the second receipt-conveying belt 95, the receipt guide 100, and a later-described receipt guide switching mechanism 110 form a receipt-conveying mechanism.

Figure 6B:
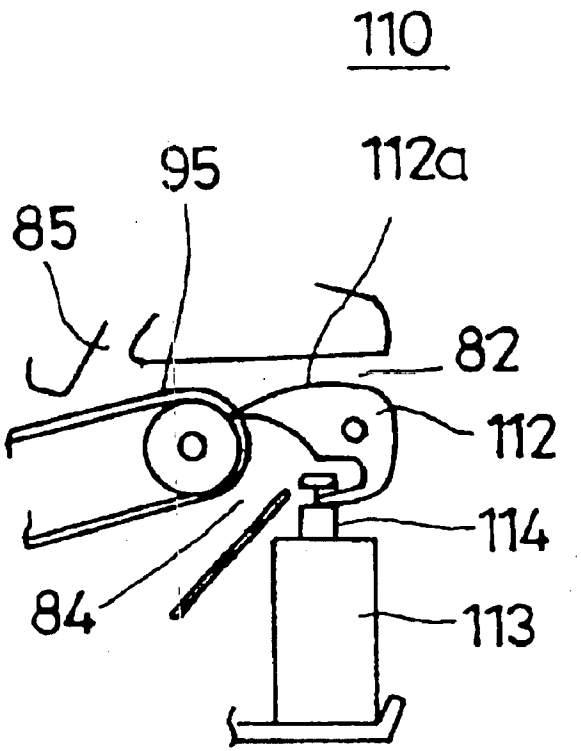
FIGS. 6A and 6B are diagrams showing a receipt guide switching mechanism of the presenter unit of FIG. 5.
Figure 6A:
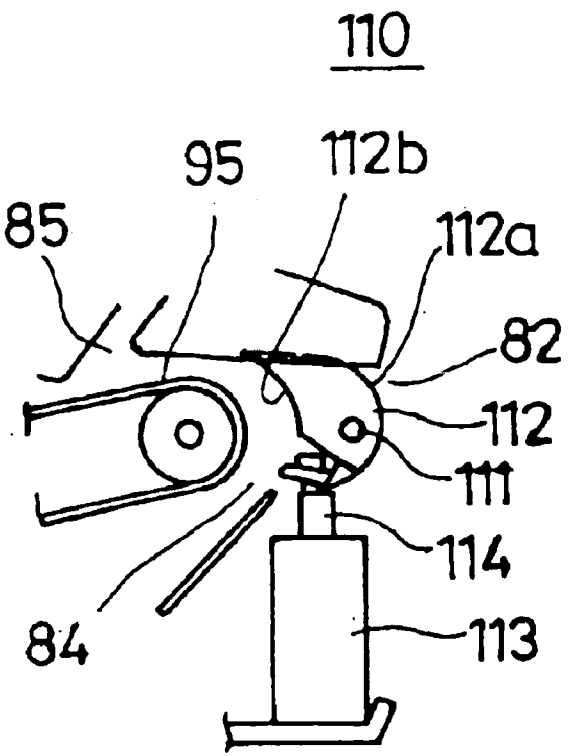

The receipt guide switching mechanism 110 shown in FIGS. 6A and 6B is provided close to where the first and third receipt ejection openings 82 and 84 are provided so as to guide the receipt to the first or third receipt ejection opening 82 or 84.

The receipt guide switching mechanism 110 is composed of a shaft 111, a guide member 112 supported turnably about the shaft 111, and a plunger 113 turning the guide member 112. The guide member 112 includes a substantially flat guide surface 112*a* and a concave arc-like guide surface 112*b*.

When the plunger 113 is switched OFF, a rod 114 is caused to project by a spring (not shown in the drawing) to turn the guide member 112 clockwise so that the first receipt ejection opening 82 is closed by the guide member 112 with the third receipt ejection member 84 being open as shown in FIG. 6A. The guide surface 112*b* is in a state to guide the receipt.

When the plunger 113 is switched ON, the rod 114 is retracted to turn the guide member 112 counterclockwise so that the third receipt ejection opening 84 is closed by the guide member 112 with the first receipt ejection opening 82 being open as shown in FIG. 6B. The guide surface 112*a* is in a state to guide the receipt.

If the plunger 113 has a failure, the receipt guide switching mechanism 110 is in the same state as when the plunger 113 is switched OFF, and the receipt is prevented from being ejected from the first receipt ejection opening 82 even if a later-described receipt ejection operation is performed.

The receipt-issuing printer 40 has the above-described configuration

Figure 1:
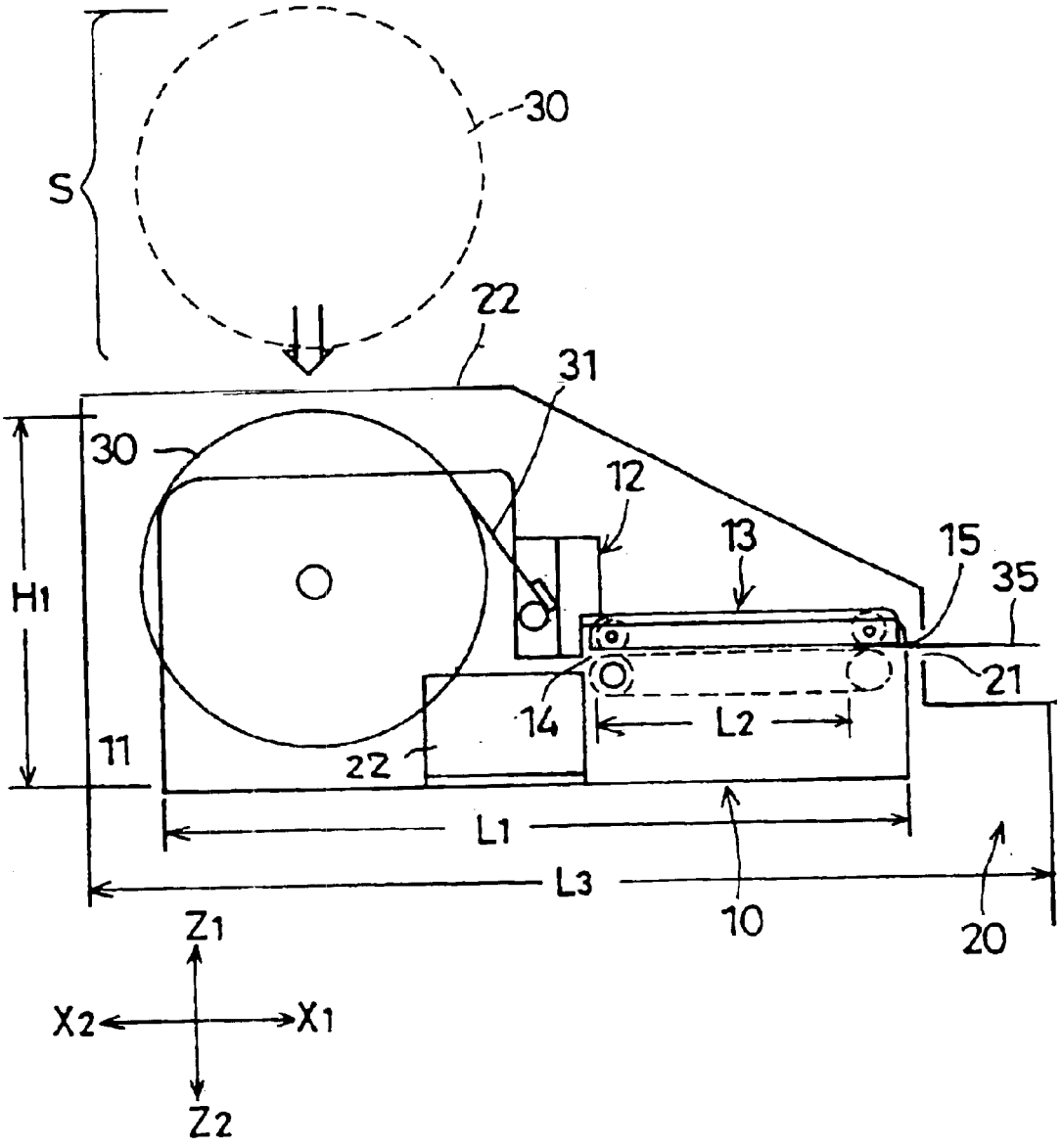
FIG.1 PRIOR ART
FIG. 1 is a diagram showing a conventional receipt-issuing printing apparatus.

In the receipt-issuing printer 40, the paper roll containing part 50 and the printer unit 60 are arranged side by side along the $X_1$–$X_2$ axis, and the presenter unit 80 is provided to extend, along the $X_1$–$X_2$ axis below the paper roll containing part 50 and the printer unit 60. Further, as shown in FIG. 4, the length $L_{10}$ of the presenter unit 80 is substantially equal to the length $L_{11}$ of the paper roll containing part 50 and the printer unit 60 combined. Therefore, while the height $H_{10}$ of the printer 40 is slightly larger than the height $H_1$ of the conventional printing apparatus 10 shown in FIG. 1, the length $L_{20}$ is approximately half of the length $L_1$ of the printing apparatus 10. Thus, the printer 40 is smaller in size than the conventional printing apparatus 10 shown in FIG. 1. Accordingly, the length $L_{30}$ along the $X_1$–$X_2$ axis of an ATM main body 120 in which the receipt-issuing printer 40 is incorporated is smaller than the length $L_3$ of the ATM main body 20 shown in FIG. 1.

Since the presenter unit 80 is provided below the paper roll containing part 50 and the printer unit 60, the length of a receipt to be issued is not restricted by the length of the presenter unit 80.

In the receipt-issuing printer 40, the three receipt ejection openings 82 through 84 are provided on the $X_1$, $X_2$, and $Z_2$ sides, respectively. Therefore, the mode of incorporating the receipt-issuing printer 40 into the ATM main body 120 can be selected from three modes shown in FIGS. 7A through 7C.

Figure 7A:
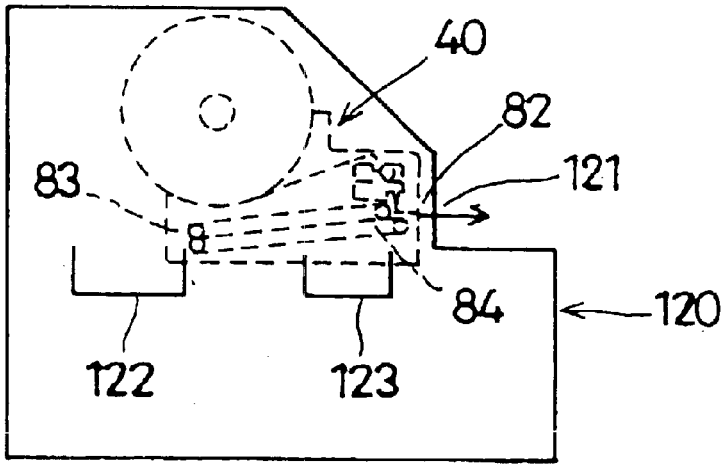
FIGS. 7A through 7C are diagrams showing positions in which the receipt-issuing line thermal printer of FIG. 2 is incorporated in ATMs.

FIG. 7A shows the first mode. According to the first mode, the receipt-issuing printer 40 is incorporated in the ATM main body 120 in the position shown in FIGS. 2 through 4 so that the first receipt ejection opening 82 opposes a receipt issuance opening 121 of the ATM main body 120.

Inside the ATM main body 120, a receipt collection box 122 is provided at a position corresponding to the second receipt ejection opening 83 so as to receive the receipt ejected therefrom, and a receipt collection box 123 is provided at a position corresponding to the third receipt ejection opening 84 so as to receive the receipt ejected therefrom.

The control setting circuit of the receipt-issuing printer 40 is set so that the first receipt ejection opening 82 is used for receipt ejection, the second receipt ejection opening 83 is used basically for receipt collection, and the third receipt ejection opening 84 is used basically for receipt collection as indicated by (a) in FIG. 12. The second and third receipt ejection openings 83 and 84 may be set to be used for receipt ejection. In some cases, the second receipt ejection opening 83 and/or the third receipt ejection opening 84 may be set to be used for neither receipt ejection nor receipt collection.

Therefore, the receipt-issuing printer 40 may have six setting patterns as indicated by (a) in FIG. 12.

Figure 7B:
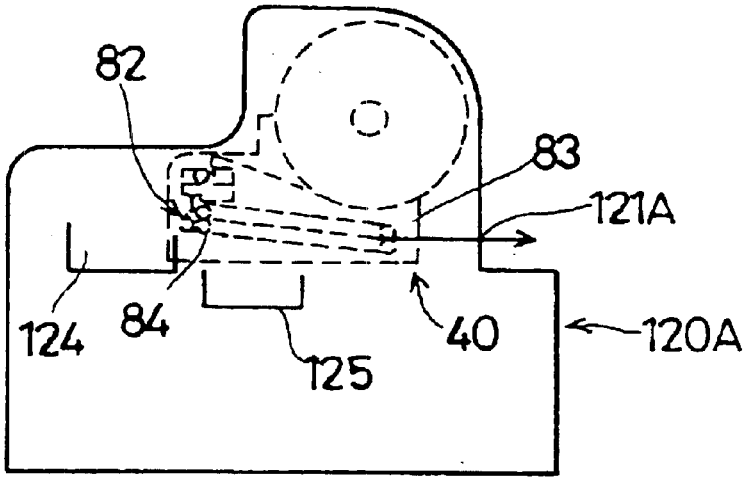

FIG. 7B shows the second mode. According to the second mode, the receipt-issuing printer 40 is incorporated in an ATM main body 120A in the position reverse to that of the first mode with respect to the $X_1$–$X_2$ axis so that the second receipt ejection opening 83 opposes a receipt issuance opening 121A of the ATM main body 120A.

Inside the ATM main body 120A, a receipt collection box 124 is provided at a position corresponding to the first receipt ejection opening 82 so as to receive the receipt ejected therefrom, and a receipt collection box 125 is provided at a position corresponding to the third receipt ejection opening 84 so as to receive the receipt ejected therefrom.

In this case, the control setting circuit of the receipt-issuing printer 40 is set so that the second receipt ejection opening 83 is used for receipt ejection, the first receipt ejection opening 82 is used basically for receipt collection, and the third receipt ejection opening 84 is used basically for receipt collection as indicated by (b) in FIG. 12. The first and third receipt ejection openings 82 and 84 may be set to be used for receipt ejection. In some cases, the first receipt ejection opening 82 and/or the third receipt ejection opening 84 may be set to be used for neither receipt ejection nor receipt collection.

Accordingly, the receipt-issuing printer 40 may have six setting patterns as indicated by (b) in FIG. 12.

Figure 7C:
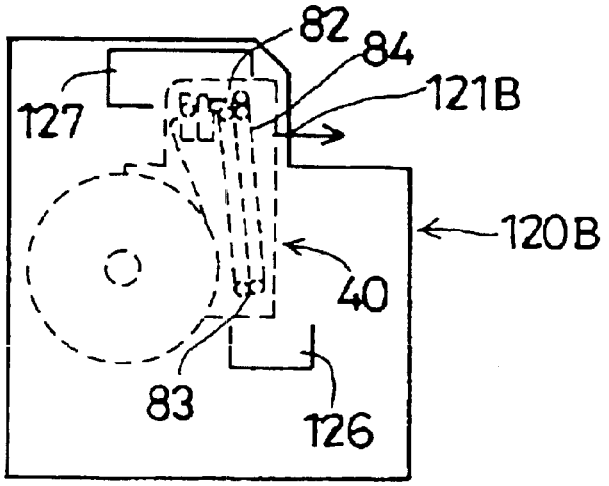

FIG. 7C shows the third mode. According to the third mode, the receipt-issuing printer 40 is incorporated into an ATM main body 120B in a standing position with the $X_1$ side in FIGS. 2 through 4 being the upper side so that the third receipt ejection opening 83 opposes a receipt issuance opening 121B of the ATM main body 120B.

Inside the ATM main body 120B, a receipt collection box 126 is provided at a position corresponding to the second receipt ejection opening 83 so as to receive the receipt ejected therefrom, and a receipt collection box 127 is provided at a position corresponding to the first receipt ejection opening 82 so as to receive the receipt ejected therefrom.

In this case, the control setting circuit of the receipt-issuing printer 40 is set so that the third receipt ejection opening 84 is used for receipt ejection, the first receipt ejection opening 82 is used basically for receipt collection, and the second receipt ejection opening 83 is used basically for receipt collection as indicated by (c) in FIG. 12. The first and second receipt ejection openings 82 and 83 may be set to be used for receipt ejection. In some cases, the first receipt ejection opening 82 and/or the second receipt ejection opening 83 may be set to be used for neither receipt ejection nor receipt collection.

Accordingly, the receipt-issuing printer 40 may have six setting patterns as indicated by (c) in FIG. 12.

As described above, the receipt-issuing printer 40 is incorporated into the ATM main body in a suitable way for the external form thereof. Accordingly, the ATM is easier to design with more design freedom.

Next, a description will be given, with reference to FIGS. 8A through 8D and 9, of an operation of the printer 40 when the printer 40 is incorporated in the ATM main body 120 in the first mode shown in FIG. 7A.

With the paper roll 130 being set in the paper roll containing part 50, the printer 40 operates in the following manner. The heat-sensitive side of the paper roll 130 faces outward.

Receipt Preparation Mode

Figure 8A:
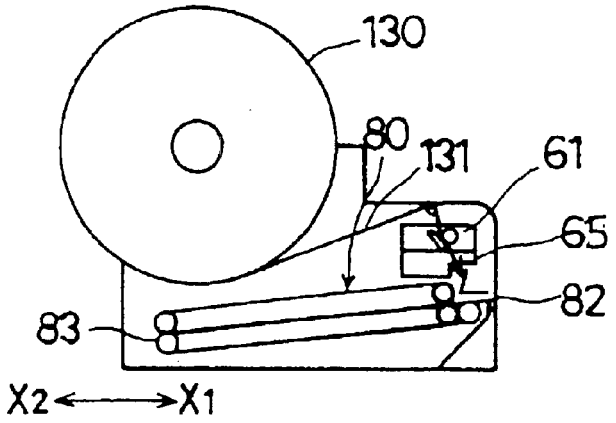
FIGS. 8A through 8D are diagrams for illustrating operations of the receipt-issuing line thermal printer of FIG. 2.

This mode is illustrated in FIG. 8A. The printer part 61 performs printing on heat-sensitive (roll) paper 131 while pulling the paper 131 from the paper roll 130. When printing is completed, the cutter part 65 operates to cut the paper 131 Thereby, a receipt 135 is prepared. The receipt 135 and a later-described ticket may be referred to as a cut piece of paper. In the process of preparation, the receipt 135 has a leading edge 135*a* thereof first entering the presenter unit 80 through the receipt reception opening 81. Then, the receipt 135 is delivered obliquely downward with respect to the $X_2$ direction inside the receipt guide 85 to be placed on the second receipt-conveying belt 95.

At this point, the motor 87 is driven at a low speed in the forward rotational direction so that the first and second conveying belts 86 and 95 run to move the receipt 135 in the $X_2$ direction. The receipt 135 is delivered first by the second receipt-conveying belt 95 and next by the first receipt-conveying belt 86 on the receipt guide 100 at a low speed in the $X_2$ direction without the paper 131 sent out from the printer unit 60 being pulled. That is, the receipt 135 is delivered in the $X_2$ direction without affecting the printer unit 60. The leading edge 135*a* of the receipt 135 is ejected from the second receipt ejection opening 83 and fed into the receipt collection box 122 to remain therein, so that the receipt 135 is contained in the receipt collection box 122, becoming folded back and forth in an undulating or zigzag manner. Accordingly, it does not matter how far the leading edge 135*a* of the receipt 135 goes, and the receipt 135 is issued without a limit to the number of lines printed thereon.

The plunger 113 is switched OFF, so that the receipt guide switching mechanism 110 is in the state shown in FIG. 6A to close the first receipt ejection opening 82.

Receipt Conveyance Mode

Figure 8B:
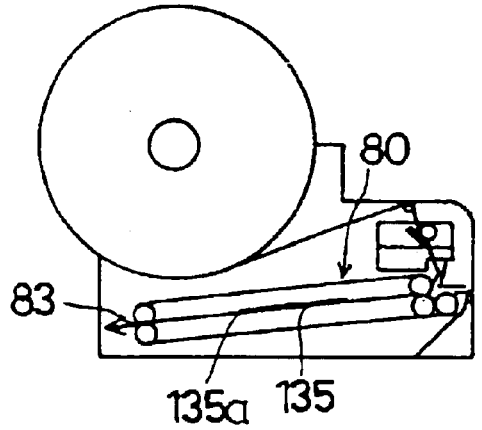

This mode is illustrated in FIG. 8B. When printing is completed and the paper 131 is cut, the motor 87 is driven at a normal speed in the forward rotational direction, so that the receipt 135 is conveyed inside the presenter unit 80 in the $X_2$ direction with a print-side surface 135*c* thereof facing upward. The receipt 135 is conveyed until a trailing edge 135*a* thereof is detected by the receipt detection sensor 107.

Receipt Ejection Mode

Figure 8C:
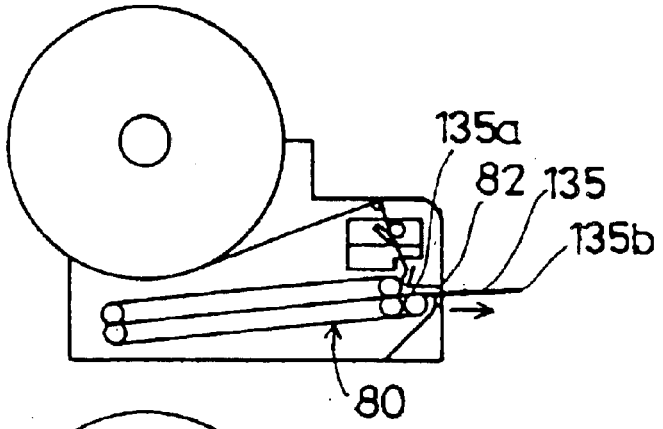

This mode is illustrated in FIG. 8C. The plunger 113 is switched ON, so that the receipt guide switching mechanism 110 is in the state shown in FIG. 6B to open the first receipt ejection opening 82. The third receipt ejection opening 84 is closed.

The motor 87 is driven at the normal speed in the reverse rotational direction so that the first and second receipt-conveying belts 86 and 95 run to move the receipt 135 in the $X_1$ direction.

The receipt 135 is conveyed first by the first receipt-conveying belt 86 and next by the second receipt-conveying belt 95 on the receipt guide 100 in the $X_1$ direction so as to protrude, first from its trailing edge 135*b*, from the receipt issuance opening 121 through the first receipt ejection opening 82. When the receipt detection sensor 106 detects the leading edge 135*a* of the receipt 135, the motor 87 is stopped.

The receipt 135 is ejected, protruding from the receipt issuance opening 121 with its leading edge part being held by the receipt holding part 102. As shown in FIG. 3, the receipt 135 is ejected in a position with a printed part 136 thereof facing upward so that a customer is allowed to see the printed contents on the receipt 135. This position of the receipt 135 is referred to as a normal state.

Receipt Collection Mode

Figure 8D:
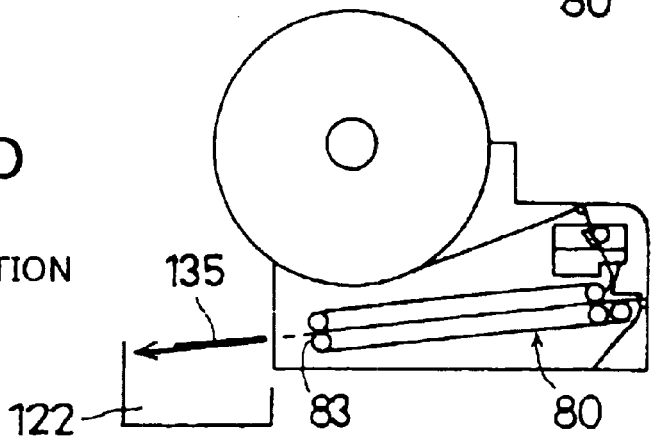

This mode is illustrated in FIG. 8D. If the customer forgets to pick up the receipt 135 so that the receipt 135 is left behind at the first receipt ejection opening 82 even after a given period of time $T_1$ passes since the completion of ejection, the motor 87 is started to be driven at the normal speed in the forward rotational direction so that the first and second receipt-conveying belts 86 and 95 operate in the reverse direction. Thereby, the receipt 135 is conveyed in the $X_1$ direction to be pulled into the receipt issuance opening 121. Thereafter, the receipt 135 is ejected from the second receipt ejection opening 83 to be delivered and collected into the receipt collection box 122.

When the receipt collection box 122 is filled up with collected receipts, the motor 87 is started to be driven first in the forward rotational direction temporarily and then in the reverse rotational direction. The plunger 113 is switched OFF so that the receipt guide switching mechanism 110 is in the state shown in FIG. 6A to close the first receipt ejection opening 82 and open the third receipt ejection opening 84. Thereby, after being pulled into the receipt issuance opening 121, the receipt 135 is ejected through the third receipt ejection opening 84 to be collected into the receipt collection box 123.

Figure 9:
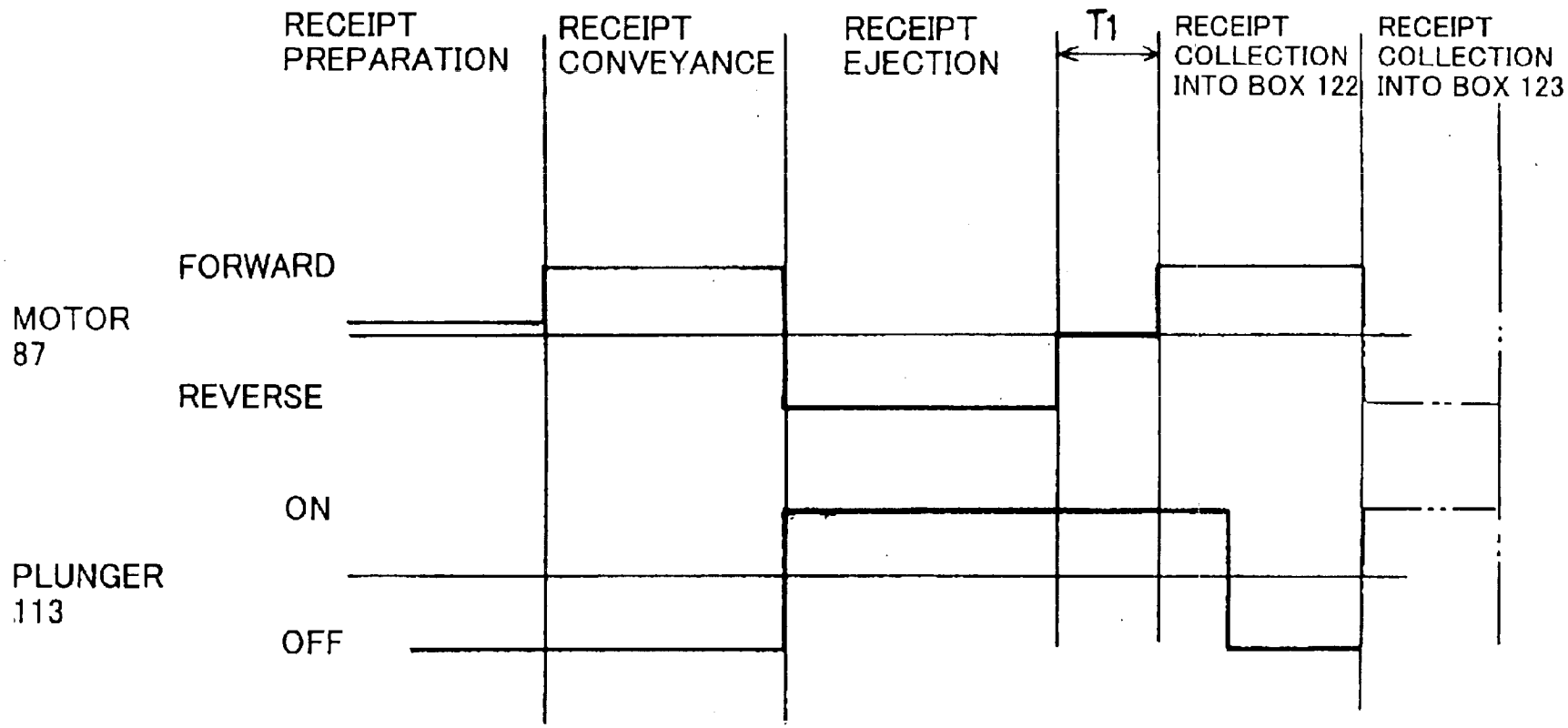
FIG. 9 is a timing chart showing a relationship between an operation of a motor and an operation of a plunger when the receipt-issuing line thermal printer of FIG. 2 is in operation.

A relationship between the operation of the motor 87 and the operation of the plunger 113 through the receipt preparation mode, the receipt conveyance mode, the receipt ejection mode, and the receipt collection mode is shown in FIG. 9.

In the case of being incorporated into the ATM main body as shown in FIG. 7B or 7C, the receipt-issuing printer 40 also operates in the order of the receipt preparation mode, the receipt conveyance mode, the receipt ejection mode, and the receipt collection mode as described above.

In the receipt conveyance mode in the ATM shown in FIG. 7B, the receipt 135 is conveyed to be ejected from the first receipt ejection opening 82 or the third receipt ejection opening 84. From the receipt conveyance mode to the receipt ejection mode, the receipt 135 is conveyed to be ejected from the second receipt ejection opening 83. In the receipt collection mode, the receipt 135 is ejected from the first receipt ejection opening 82 to be collected into the receipt collection box 124, or ejected from the third receipt ejection opening 84 to be collected into the receipt collection box 125.

In the receipt conveyance mode in the ATM shown in FIG. 7C, the receipt 135 is conveyed to be ejected from the second receipt ejection opening 83. From the receipt conveyance mode to the receipt ejection mode, the receipt 135 is conveyed to be ejected from the third receipt ejection opening 84. In the receipt collection mode, the receipt 135 is ejected from the second receipt ejection opening 83 to be collected into the receipt collection box 126, or ejected from the first receipt ejection opening 82 to be collected into the receipt collection box 127. In the case of issuing tickets instead of receipts, ticket ejection and collection operations are equal to those described above. The cut piece of paper is a concept including a receipt and a ticket.

Next, a description will be given of parts of the receipt-issuing printer 40 other than those described above.

Paper Roll Containing Part 50

Figure 10:
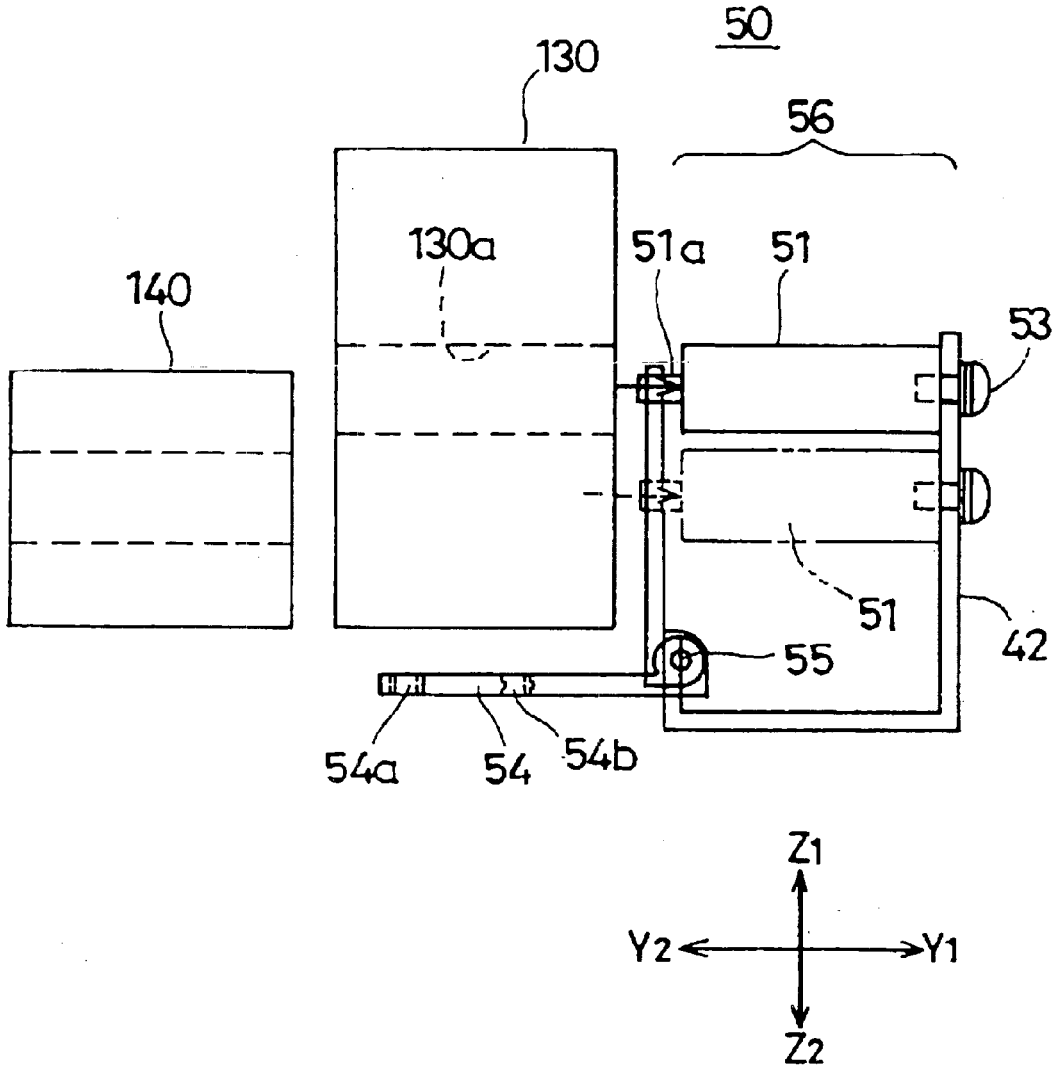
FIG. 10 is a diagram showing a structure of a paper roll containing part of the receipt-issuing line thermal printer of FIG. 2.

As shown in FIGS. 2, 3, and 10, the paper roll containing part 50 includes the horizontal paper roll supporting shaft 51 fixed to the frame 42 by a screw 53 and a support arm 54 hinged to the frame 42 with a shaft 55. The paper roll supporting shaft 51, which is detachable and reattachable, has a pin part 51*a* on its tip. The support arm 54 is rotated about the shaft 55 to a horizontal position along the $Y_1$–$Y_2$ axis as shown in FIG. 10 when the paper roll 130 is set in the paper roll containing part 50.

The paper roll 130 is set in the paper roll containing part 50 in the following manner. First, the paper roll 130 is moved from the $Y_2$ side to the $Y_1$ side of the paper roll containing part 50 so that the paper roll supporting shaft 51 is fitted into a center hole 130*a* of the paper roll 130. Thereby, the paper roll 130 is contained in a paper roll containing space 56. Then, the support arm 54 is rotated up so that the pin part 51*a* of the roll paper supporting shaft 51 is fitted into a hole 54*a* of the support arm 54. Thereby, the tip of the paper roll supporting shaft 51 is supported, and the paper roll containing space 56 is partially closed on the $Y_2$ side. The paper roll support shaft 51 is in a stable condition with both its ends being supported, so that the paper roll 130 is stably supported.

In the case of using a paper roll 140 of a smaller diameter, the paper roll supporting shaft 51 is detached from the frame 42 and reattached thereto at a lower position as indicated by a double-dot chain line in FIG. 10. In this state, the paper roll 140 is set in the paper roll containing part 50 in the same way as described above. The pin part 51*a* is fitted into a hole 54*b* of the support arm 54.

Since each of the paper rolls 130 and 140 is set in the paper roll containing part 50 from the $Y_2$ side (side surface side), no space for performing operations necessary for setting the paper roll 130 or 140 is required above the paper roll containing part 50.

The external dimensions of the ATM are determined in consideration of work space for setting a paper roll. In the case of setting the paper roll from above, the ATM is vertically larger in size, which is not desirable. On the other hand, in the case of setting the paper roll from the side, the ATM is horizontally larger but vertically smaller in size, which is preferable. This is because the ATM generally has more space in the sideward direction than in the upward direction when installed inside buildings.

Relationship between Paper Roll Containing Part 50 and Printer Part 61

The paper 131 is pulled obliquely upward from the lower side of the paper roll 130 and guided by the roll paper pull-in load reducing mechanism 69. Thereafter, the paper 131 is directed downward into the printer part 61 and enters between the platen roller 62 and the thermal head 63.

As shown in FIG. 2, a leading edge 131*a* of the paper 131 curls counterclockwise with respect to the paper roll 130.

The heat-sensitive side of the paper roll 130 faces outward, and the platen roller 62 and the thermal head 63 are arranged on the $X_2$ side and the $X_1$ side, respectively, of the paper 131 in the printer part 61.

When the paper 131 enters the printer part 61 from the upper side, the leading edge 131*a* thereof curls in a direction away from the thermal head 63. Therefore, compared with a case where the leading edge 131*a* of the paper 131 curls in a direction toward the surface of the thermal head 63, the paper 131 smoothly enters between the platen roller 62 and the thermal head 63.

If the paper 131 is pulled obliquely downward from the upper side of the paper roll 130, space 150 shown in FIG. 2 is required for the paper 131 to reach the printer part 61 from the paper roll 130.

According to this embodiment, however, the paper 131 is pulled obliquely upward from the lower side of the paper roll 130, and thereafter, is directed downward into the printer part 61. Therefore, unlike the case where the paper 131 is pulled obliquely downward from the upper side of the paper roll 130, the space 150 is unused, so that the receipt-issuing printer 40 becomes smaller by the volume of the unused space 150.

Figure 11A:
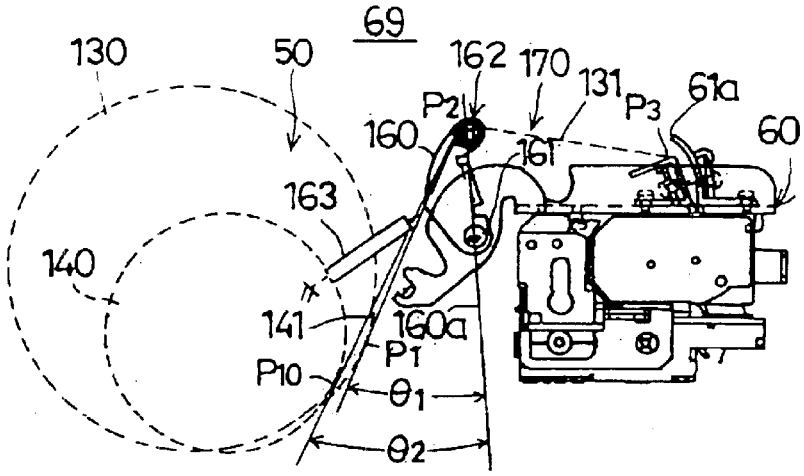
FIGS. 11A through 11C are diagrams showing a configuration and operations of a roll paper pull-in load reducing mechanism of the receipt-issuing line thermal printer of FIG. 2.
Figure 11B:
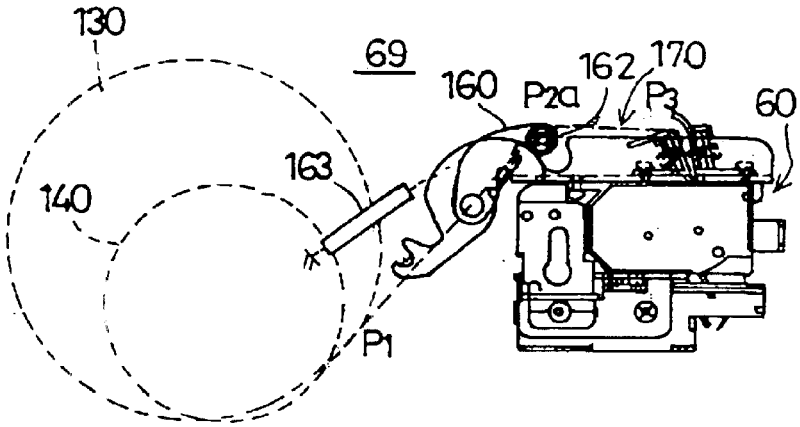
Figure 11C:
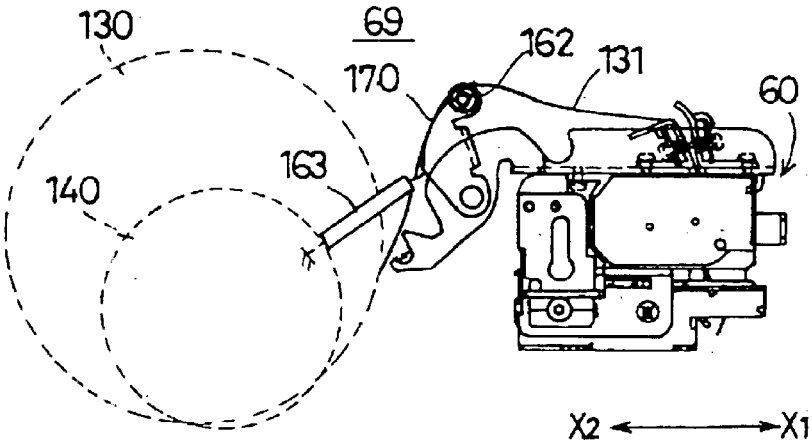

Roll Paper Pull-in Load Reducing Mechanism 69 p FIGS. 11A through 11C are diagrams showing a configuration and operations of the roll paper pull-in load reducing mechanism 69. An arm 160, which is rotatably supported on the printer unit 60 by a shaft 161, has a roller 162 on its tip. At the time of setting the roll paper 130, the arm 160 is rotated counterclockwise by a spring 163 to the position shown in FIG. 11A. The roller guides the paper 131 pulled obliquely upward from the lower side of the paper roll 130 so that the paper 131 passes points P1, P2, and P3, thereby forming an inverted V-shaped path 170. When the arm 160 is rotated clockwise so that the roller 162 is moved in the $X_1$ direction at the time of starting printing, the path 170 is reduced in length, changing position as marked by the points P1 and P3 and a point P2*a* in FIG. 11B.

The strength of the spring 163 is determined so that the arm 160 is rotated clockwise as shown in FIG. 11B when printing is started so that the printer unit 60 pulls in the paper 131 and then counterclockwise as shown in FIG. 11C when the printing is completed so that the printer unit 60 stops pulling in the paper 131.

When printing is started and the printer unit 60 starts pulling in the paper 131, the arm 160 is rotated clockwise against the force of the spring 163. The roller 162 is moved in the $X_1$ direction so that the path 170 becomes shorter in length. Accordingly, at the start of printing, the path 170 is reduced in length with the paper roll 130 at rest so that the paper 131 forming the path 170 is pulled into the printer unit 60. Therefore, a reduced load is imposed on the paper feed motor 64 at the time of starting the paper feed motor 64 so that the paper feed motor 64 is smoothly started. The arm 160 is rotatable clockwise up to the position shown in FIG. 11B.

After the arm 160 is rotated up to the position shown in FIG. 11B, the paper 131 is delivered into the printer unit 60 while the paper roll 130 is rotated counterclockwise. At this point, the paper feed motor 64 is driven rotationally, and even if the load is increased, the paper feed motor 64 stably continues rotating so that the paper 131 is stably delivered.

Therefore, printing on the paper 131 is stably performed with a given pitch.

When the printing is completed so that the printer unit 60 stops pulling in the paper 131, the arm 160 is rotated counterclockwise by the spring 163 as shown in FIG. 11C so as to pull the paper 131 up from the paper roll 130 a short distance. The paper roll 130 is thus slightly rotated so that the path 170 becomes slack as shown in FIG. 11C.

As shown in FIG. 11A, the paper 131 pulled obliquely upward from the lower side of the paper roll 130 reaches the roller 162 at an angle $\theta_1$ to an axis 160*a* of the arm 160.

The paper roll 140 smaller in diameter is fixed to the lower position so that the position $P_{10}$ from which paper 141 is pulled tangentially from the paper roll 140 is close to the point $P_1$, from which the paper 131 is pulled tangentially from the paper roll 130. Therefore, the paper 141 pulled obliquely upward from the lower side of the paper roll 140 reaches the roller 162 at an angle $\theta_2$, which approximates the angle $\theta_1$, to the axis 160*a* of the arm 160.

Accordingly, in the case of using the paper roll 140 smaller in diameter, the roll paper pull-in load reducing mechanism 69 operates in the same way as in the case of using the paper roll 130 larger in diameter. Therefore, the paper is fed stably so that printing is stably performed on the paper 141.

Further, since the angle $\theta_2$ approximates the angle $\theta_1$, it is unnecessary to change the attachment position of the arm 160 in the case of using the paper roll 140 smaller in diameter, thus saving time and trouble.

The present invention is applicable not only to thermal printers but also to printers of other types.

The present invention is not limited to the specifically disclosed embodiment, but variations and modifications may be made without departing form the scope of the present invention.

The present application is based on Japanese priority application No. 2001-208083 filed on Jul. 9, 2001, the entire contents of which are hereby incorporated by reference.

What is claimed is:

1. A printing apparatus, comprising:

a paper roll containing part adapted to contain a paper roll;

a printer unit provided side by side with said paper roll containing part, the printer unit printing information on paper pulled from the paper roll and cutting a piece of paper off the pulled paper on which said cut piece of paper the information is printed; and a presenter unit, the presenter unit comprising:

a reception opening formed on an upper side thereof and receiving the cut piece of paper delivered from said printer unit, first and second ejection openings formed on opposite ends of the presenter unit and ejecting the cut piece of paper, and a conveying mechanism conveying the cut piece of paper between the first and second ejection openings, wherein the presenter unit is provided below said paper roll containing part and said printer unit so that the cut piece of paper is delivered into the reception opening and a longitudinal dimension of said presenter unit is substantially equal to or less than a combined longitudinal dimension of said paper roll containing part and said printer unit.

2. The printing apparatus as claimed in claim 1, wherein said printer unit comprises:

a printer part printing the information on the paper pulled from the paper roll; and a cutter part cutting the piece of paper off the pulled paper on which said cut piece of paper the information is printed.

3. The printing apparatus as claimed in claim 1, further comprising a pull-in load reducing mechanism provided between said paper roll containing part and said printer unit, the pull-in load reducing mechanism reducing a load in pulling the paper from the paper roll into said printer unit by guiding the paper from the paper roll to said printer unit so that a path of the paper from the paper roll is reduced in a length thereof.

4. The printing apparatus as claimed in claim 3, wherein said paper roll containing part contains the paper roll in a position vertically adjustable in accordance with a diameter of the paper roll so that the paper is pulled from a lower side of the paper roll at a constant position irrespective of a diameter of the paper roll.

5. The printing apparatus as claimed in claim 4, wherein said pull-in load reducing mechanism comprises a rotatable arm part with a roller, the rotatable arm part being rotated from a first position in a direction opposite to a direction in which the paper roll is rotated to a second position when the paper is pulled from the paper roll into said printer unit so that the path of the paper from the paper roll is reduced in a length thereof.

6. The printing apparatus as claimed in claim 5, wherein the rotatable arm part is rotated back from the second position to the first position by a spring when said printer unit stops pulling in the paper from the paper roll.

7. The printing apparatus as claimed in claim 1, wherein said paper roll containing part comprises a horizontal support shaft supporting the paper roll, the horizontal support shaft having one end fixed to a frame of said paper roll containing part and another end free so that a center hole of the paper roll is fitted to the horizontal support shaft from a free-end side to be contained in said paper roll containing part.

8. The printing apparatus as claimed in claim 7, wherein the horizontal support shaft is detachable from a first position on the frame of said paper roll containing part and reattachable to a second position on the frame thereof so that the paper roll is contained in said paper roll containing part in a vertically adjustable manner.

9. The printing apparatus as claimed in claim 1, wherein:

the paper roll is a roll of heat-sensitive paper having heat-sensitive side thereof facing outward:

said paper roll containing part contains the paper roll so that the paper is pulled from a lower side of the paper roll; and said printer unit comprises a printer part printing the information on the paper pulled from the paper roll, the printer part comprising;

a thermal head opposing the heat-sensitive side of the paper, and a platen roller contacting a side of the paper opposite to the heat-sensitive side thereof.

10. The printing apparatus as claimed in claim 1, wherein the longitudinal dimension of said presenter unit is less than the combined longitudinal dimension of said paper roll containing part and said printer unit.

11. The printing apparatus as claimed in claim 1, wherein said presenter unit is provided opposite said paper roll containing part and said printer unit.

12. A printing apparatus, comprising:

a paper roll containing part adapted to contain a paper roll;

a printer unit provided side by side with said paper roll containing part, the printer unit printing information on paper pulled from the paper roll and cutting a piece of paper off the pulled paper on which said cut piece of paper the information is printed; and a presenter unit, said presenter unit comprising:

a reception opening formed on an upper side thereof and receiving the cut piece of paper delivered from said printer unit, first and second ejection openings formed on opposite ends of the presenter unit and ejecting the cut piece of paper, a conveying mechanism conveying the cut piece of paper between the first and second ejection openings, wherein the presenter unit is provided below said paper roll containing part and said printer unit so that the cut piece of paper is delivered into the reception opening, and a third ejection opening formed on a lower side thereof and ejecting the cut piece of paper, wherein the conveying mechanism of said presenter unit comprises a guide switching mechanism that is switched to guide the cut piece of paper to the third ejection opening.

13. The printing apparatus as claimed in claim 12, wherein the guide switching mechanism has a plunger switched off to close the first ejection opening so that the cut piece of paper is guided to the third ejection opening.

14. The printing apparatus as claimed in claim 12, wherein the guide switching mechanism has a plunger switched on to close the third ejection opening so that the cut piece of paper is guided to the first ejection opening.

15. A printing apparatus, comprising:

a paper roll containing part adapted to contain a paper roll;

a printer unit provided side by side with said paper roll containing part, the printer unit printing information on paper pulled from the paper roll and cutting a piece of paper off the pulled paper on which said cut piece of paper the information is printed; and a presenter unit, the presenter unit comprising:

a reception opening formed on an upper side thereof and receiving the cut piece of paper delivered from said printer unit, first and second ejection openings formed on opposite ends of the presenter unit and ejecting the cut piece of paper, and a conveying mechanism conveying the cut piece of paper between the first and second ejection openings, wherein the presenter unit is provided below said paper roll containing part and said printer unit so that the cut piece of paper is delivered into the reception opening, wherein said paper roll containing part comprises:

a horizontal support shaft supporting the paper roll, the horizontal support shaft having one end fixed to a frame of said paper roll containing part and another end free so that a center hole of the paper roll is fitted to the horizontal support shaft from a free-end side to be contained in said paper roll containing part, and an arm part rotatably attached to the frame, the arm part rotating to fit to and support the free end of the horizontal support shaft.

16. A terminal apparatus, comprising:

a printing apparatus, the printing apparatus comprising:

a paper roll containing part adapted to contain a paper roll;

a printer unit provided side by side with said paper roll containing part, the printer unit printing information on paper pulled from the paper roll and cutting a piece of paper off the pulled paper on which said cut piece of paper the information is printed; and a presenter unit, the presenter unit comprising:

a reception opening formed on an upper side thereof and receiving the cut piece of paper delivered from said printer unit, first and second ejection openings formed on opposite ends of the presenter unit and ejecting the cut piece of paper, and a conveying mechanism conveying the cut piece of paper between the first and second ejection openings, wherein the presenter unit is provided below said paper roll containing part and said printer unit so that the cut piece of paper is delivered into the reception opening and a longitudinal dimension of said presenter unit is substantially equal to or less than a combined longitudinal dimension of said paper roll containing part and said printer unit.

17. The terminal apparatus as claimed in claim 16, wherein said printer unit comprises:

a printer part printing the information on the paper pulled from the paper roll; and a cutter part cutting the piece of paper off the pulled paper on which said cut piece of paper the information is printed.

18. The terminal apparatus as claimed in claim 16, wherein said printing apparatus comprises a pull-in load reducing mechanism provided between said paper roll containing part and said printer unit, the pull-in load reducing mechanism reducing a load in pulling the paper from the paper roll into said printer unit by guiding the paper from the paper roll to said printer unit so that a path of the paper from the paper roll is reduced in a length thereof.

19. The terminal apparatus as claimed in claim 18, wherein said paper roll containing part contains the paper roll in a position vertically adjustable in accordance with a diameter of the paper roll so that the paper is pulled from a lower side of the paper roll at a constant position irrespective of the diameter of the paper roll.

20. The terminal apparatus as claimed in claim 19, wherein said pull-in load reducing mechanism comprises a rotatable arm part with a roller, the rotatable arm part being rotated from a first position in a direction opposite to a direction in which the paper roll is rotated to a second position when the paper is pulled from the paper roll into said printer unit so that the path of the paper from the paper roll is reduced a in length thereof.

21. The terminal apparatus as claimed in claim 20, wherein the rotatable arm part is rotated back from the second position to the first position by a spring when said printer unit stops pulling in the paper from the paper roll.

22. The terminal apparatus as claimed in claim 16, wherein said paper roll containing part comprises a horizontal support shaft supporting the paper roll, the horizontal support shaft having one end fixed to a frame of said paper roll containing part and another end free so that a center hole of the paper roll is fitted to the horizontal support shaft from a free-end side to be contained in said paper roll containing part.

23. The terminal apparatus as claimed in claim 22, wherein the horizontal support shaft is detachable from a first position on the frame of said paper roll containing part and reattachable to a second position on the frame thereof so that the paper roll is contained in said paper roll containing part in a vertically adjustable manner.

24. The terminal apparatus as claimed in claim 16, wherein:

the paper roll is a roll of heat-sensitive paper having heat-sensitive side thereof facing outward;

said paper roll containing part contains the paper roll so that the paper is pulled from a lower side of the paper roll; and said printer unit comprises a printer part printing the information on the paper pulled from the paper roll, the printer part comprising:

a thermal head opposing the heat-sensitive side of the paper, and a platen roller contacting a side of the paper opposite to the heat-sensitive side thereof.

25. The terminal apparatus as claimed in claim 16, wherein the longitudinal dimension of said presenter unit is less than the combined longitudinal dimension of said paper roll containing part and said printer unit.

26. The terminal apparatus as claimed in claim 16, wherein said presenter unit is provided opposite said paper roll containing part and said printer unit.

27. A terminal apparatus, comprising:

a printing apparatus, the printing apparatus comprising:

a paper roll containing part adapted to contain a paper roll, a printer unit provided side by side with said paper roll containing part, the printer unit printing information on paper pulled from the paper roll and cutting a piece off the pulled paper on which said piece the information is printed, and a presenter unit, said presenter unit comprising:

a reception opening formed on an upper side thereof and receiving the cut piece of paper delivered from said printer unit, first and second ejection openings formed on opposite ends of the presenter unit and ejecting the cut piece of paper, a conveying mechanism conveying the cut piece of paper between the first and second ejection openings, wherein the presenter unit is provided below said paper roll containing part and said printer unit so that the cut piece of paper is delivered into the reception opening, and a third ejection opening formed on a lower side thereof and ejecting the cut piece of paper, wherein the conveying mechanism of said presenter unit comprises a guide switching mechanism that is switched to guide the cut piece of paper to the third ejection opening.

28. The terminal apparatus as claimed in claim 27, wherein the guide switching mechanism has a plunger switched off to close the first ejection opening so that the cut piece of paper is guided to the third ejection opening.

29. The terminal apparatus as claimed in claim 27, wherein the guide switching mechanism has a plunger switched on to close the third ejection opening so that the cut piece of paper is guided to the first ejection opening.

30. The terminal apparatus as claimed in claim 27, further comprising:

an opening formed at a position corresponding to the first ejection opening of said presenter unit so that the cut piece of paper ejected from the first ejection opening is ejected outside of the terminal apparatus through the opening; and boxes to collect the cut piece of paper, the boxes being provided at positions corresponding to the second and third ejection openings.

31. A terminal apparatus, comprising:

a printing apparatus, the printing apparatus comprising:

a paper roll containing part adapted to contain a paper roll, a printer unit provided side by side with said paper roll containing part, the printer unit printing information on paper pulled from the paper roll and cutting a piece of paper off the pulled paper on which said cut piece of paper the information is printed, and a presenter unit having first and second opposite sides, the presenter unit comprising:

a reception opening formed on the first side thereof and receiving the cut piece of paper delivered from said printer unit, first and second ejection openings formed on opposite ends of the presenter unit and ejecting the cut piece of paper, a conveying mechanism conveying the cut piece of paper between the first and second ejection openings, wherein said presenter unit is provided in a position opposite said paper roll containing part and said printer unit so that the cut piece of paper is delivered into the reception opening, and a third ejection opening formed on the second side thereof and ejecting the cut piece of paper, and wherein:

the conveying mechanism of said presenter unit comprises a guide switching mechanism that is switched to guide the cut piece of paper to the third ejection opening; an opening is formed in the terminal apparatus at a position corresponding to the third ejection opening of said presenter unit so that the cut piece of paper ejected from the third ejection opening is ejected outside of the terminal apparatus through the opening; and boxes to collect the cut piece of paper are provided in the terminal apparatus at positions corresponding to the first and second ejection openings.

32. A terminal apparatus, comprising:

a printing apparatus, the printing apparatus comprising:

a paper roll containing part adapted to contain a paper roll, a printer unit provided side by side with said paper roll containing part, the printer unit printing information on paper pulled from the paper roll and cutting a piece of paper off the pulled paper on which said cut piece of paper the information is printed, and a presenter unit, the presenter unit comprising:

a reception opening formed on an upper side thereof and receiving the cut piece of paper delivered from said printer unit, first and second ejection openings formed on opposite ends of the presenter unit and ejecting the cut piece of paper, and a conveying mechanism conveying the cut piece of paper between the first and second ejection openings, wherein the presenter unit is provided below said paper roll containing part and said printer unit so that the cut piece of paper is delivered into the reception opening, wherein said paper roll containing part comprises:

a horizontal support shaft supporting the paper roll, the horizontal support shaft having one end fixed to a frame of said paper roll containing part and another end free so that a center hole of the paper roll is fitted to the horizontal support shaft from a free-end side to be contained in said paper roll containing part, and an arm part rotatably attached to the frame, the arm part rotating to fit to and support the free end of the horizontal support shaft.

* * * * *

UNITED STATES PATENT AND TRADEMARK OFFICE

CERTIFICATE OF CORRECTION

PATENT NO. : 6,814,515 B2
DATED : November 9, 2004
INVENTOR(S) : Masahiro Tsuchiya et al.

It is certified that error appears in the above-identified patent and that said Letters Patent is hereby corrected as shown below:

Column 13,
Line 19, change "." to -- ; --;

Column 15,
Line 22, change "reduced a in" to -- reduced in a --.

Signed and Sealed this

Seventh Day of June, 2005

JON W. DUDAS
*Director of the United States Patent and Trademark Office*